United States Patent [19]

Kennedy et al.

[11] Patent Number: 4,899,696

[45] Date of Patent: Feb. 13, 1990

[54] COMMERCIAL STORAGE WATER HEATER PROCESS

[75] Inventors: Jeffery M. Kennedy, Santa Clara; Andrew C. Minden, La Honda, both of Calif.

[73] Assignee: Gas Research Institute, Chicago, Ill.

[21] Appl. No.: 920,207

[22] Filed: Oct. 17, 1986

Related U.S. Application Data

[63] Continuation of Ser. No. 775,507, Sep. 12, 1985, abandoned.

[51] Int. Cl.[4] ..... F22B 5/00

[52] U.S. Cl. ..... 122/13 R; 126/94 AC; 122/182 R; 431/328

[58] Field of Search ..... 122/13 R, 44 A, 14–17, 122/161, 182 R, 182 S, 155, 165; 126/361, 362, 92 AC; 431/328

[56] References Cited

U.S. PATENT DOCUMENTS

| | | | |
|---|---|---|---|
| 1,582,657 | 4/1926 | Andrews | 126/92 AC |
| 1,718,960 | 7/1929 | Humphrey | 126/92 AC |
| 1,734,310 | 11/1929 | Taylor | 122/182 R |
| 1,884,746 | 10/1932 | Kline et al. | 126/92 AC |
| 2,003,742 | 6/1935 | Elliott | 122/17 |
| 2,311,657 | 2/1943 | Grundle | 122/182 R |
| 2,383,924 | 8/1945 | Way et al. | 122/182 R |
| 2,552,044 | 5/1951 | Huet | 122/13 R |
| 2,593,032 | 4/1952 | Johnson | 122/13 R |
| 2,787,256 | 4/1957 | Ilune | 122/182 R |
| 3,383,159 | 5/1968 | Smith | 122/13 R |
| 3,638,622 | 2/1972 | Ostbo | 122/182 R |
| 4,170,963 | 10/1979 | Siegrist | 122/182 S |
| 4,192,260 | 3/1980 | Ostbo | 122/182 R |
| 4,329,943 | 5/1982 | Schworer | 122/161 |
| 4,354,823 | 10/1982 | Buehl et al. | 431/328 |
| 4,380,215 | 4/1983 | Mendelcon | 122/13 R |
| 4,416,619 | 11/1983 | Craig et al. | 431/328 |
| 4,465,025 | 8/1984 | Schroder | 122/161 |
| 4,547,148 | 10/1985 | Holmer | 431/328 |
| 4,582,024 | 4/1986 | Wihelm | 122/162 |

*Primary Examiner*—Henry C. Yuen

*Attorney, Agent, or Firm*—Flehr, Hohbach, Test, Albritton & Herbert

[57] ABSTRACT

A commercial storage water heater process including a storage tank which is heated by a fiber matrix radiant burner positioned within an upright combustion tube at the lower end of the tank. A mixture of natural gas and air is forced by a blower at the upper end of the tank down through an inlet conduit and into the burner with combustion taking place flamelessly along the outer surface of the burner to radiate thermal energy to the combustion tube which is turn heats the water. Exhaust gases from the burner are directed along a path leading upwardly through a plurality of flue tubes which transfer a part of the residual energy of the gases into the water. Exhaust gases exiting the flue tubes are directed through an outlet port and vented to a stack. The combustion tube and outlet port are positioned radially offset and on opposite sides of the longitudinal axis of the tank to facilitate access to the combustion tube and burner.

9 Claims, 2 Drawing Sheets

COMMERCIAL STORAGE WATER HEATER PROCESS

This is a continuation of application Ser. No. 775,507 filed Sept. 12, 1985, now abandoned.

invention relates to water heaters for commercial application, and particularly relates to commercial storage water heaters of that type rated at approximately 3,785 liters/day capacity hot water demand.

Conventional commercial water heaters typically employ an upright cylindrical tank having the burner unit mounted beneath the tank. The burner units are of the natural draft, gas-fired type which produce an open flame transferring heat primarily by convection to water on the tank, and flue tubes extend upwardly through the tank with the exhaust gases venting from the upper end. Water heaters of this type normally operate with no better than about 78% steady state efficiency. The open flame burners can also produce significant amounts of pollutant $NO_x$ emissions. In hard water environments the conventional heaters can encounter reduced operating life due to liming in which a buildup of insoluble deposits on the inside bottom of the tank gradually forms an insulation layer between the water and the burners, and this can lead to hot spots and burnout in the tank bottom wall. The mounting of the burners, air/fuel inlets and burner controls beneath the tank near the supporting floor also creates potential service interruption problems, such as from water flooding reaching the controls.

It is a general object of the invention, therefore, to provide a new and improved water heater process for use in commercial applications which obviates or reduces the limitations of conventional water heaters.

Another object is to provide a commercial storage water heater process which achieves improved efficiency and thereby lower fuel costs for comparable hot water requirements.

Another object is to provide a water heater process of the type described which produces reduced pollutant exhaust emissions as compared to conventional water heaters.

Another object is to provide a water process heater of the type described which is dependable in operation with the burner controls and air/fuel inlets positioned at or near the upper end of the storage tank.

Another object is to provide a water heater process of the type described which has the potential for a relatively longer life as compared to conventional heaters.

The invention in summary provides a process of heating water on the storage chamber of hot water tank on which fiber matrix radiant burner is concentrically mounted within a combustion tube. In the process mixture of fuel and air is directed into the burner and radially outwardly for flameless combustion on the outer burners surface layer. Thermal energy is transferred primarily by radiation to the combustion tube which in turn heats the water. Exhaust gases are directed from the burner along a path through flue tubes immersed in the water for transferring residual thermal energy from the gases into the water.

The foregoing and additional objects and features of the invention will appear from the following specification in which the several embodiments have been set forth in detail in conjunction with the accompanying drawings.

Figure 1:
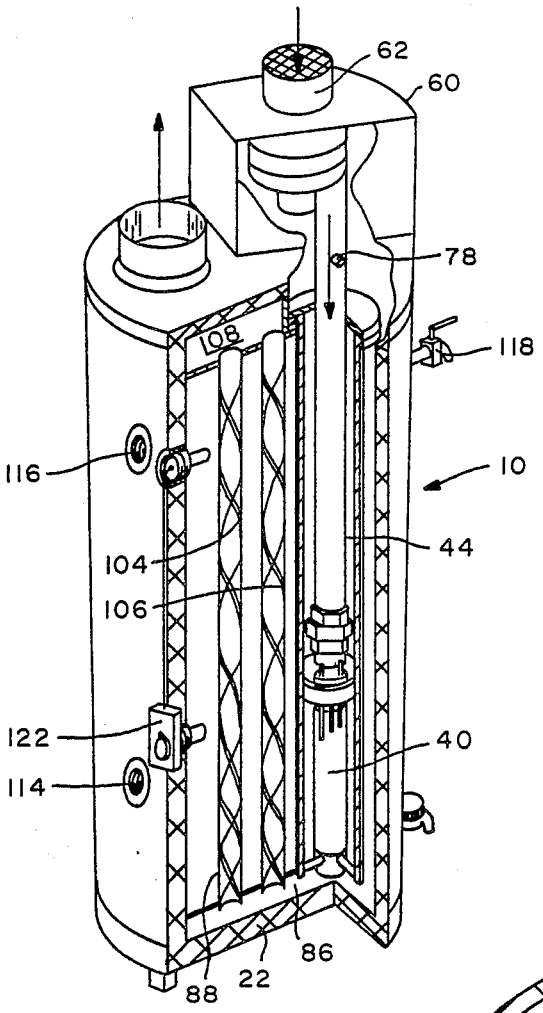
FIG. 1 is a perspective, partially cut-away, view of a commercial storage water heater which carries out the process of the invention.
Figure 3:
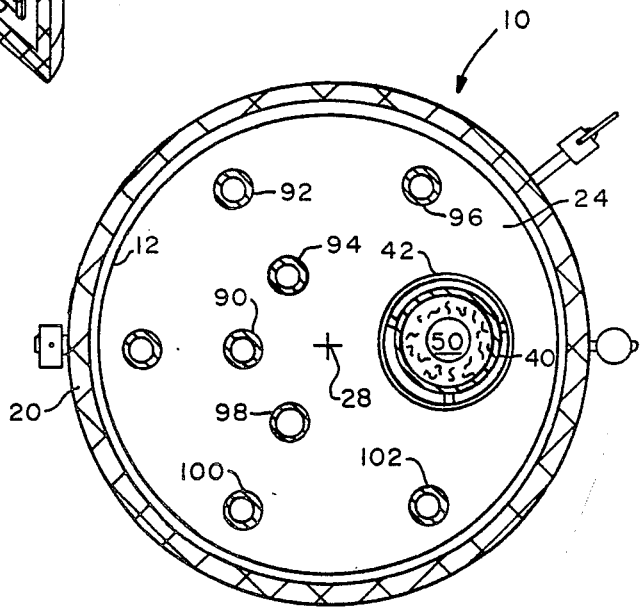
FIG. 3 is a cross-section view taken along the line 3—3 of FIG. 2.

In the drawings the commercial storage water heater which carries out the process according to a preferred embodiment of the invention is illustrated generally at 10. The heater is comprised of a tank 11 formed by a cylindrical side wall 12 and upper and lower ends 14, 16 which define a water storage chamber 18. Tank 11 is sized according to the specifications and requirements for a particular application, and for the typical commercial water storage application the tank capacity would be sufficient to supply hot water demand of at least 1,900 liters/day. The tank is thermally insulated by an insulation layer 20 mounted completely around the side wall, a bottom insulation layer 22 spaced below tank lower end 16, and a top insulation layer 24 spaced above upper end 14. A plurality of feet 26 depend below lower layer 22 for supporting the tank upright with its longitudinal axis vertical.

At a position radially spaced from center axis 28 of the tank a circular opening 30 is formed through top insulation layer 24, and a concentric opening 32 of smaller diameter is formed through tank upper end 14. An elongate cylindrical shell 34 fitted at its upper end with a cylindrical mounting plate 36 is inserted through the openings 30 and 32 with the mounting plate detachably secured to tank upper end 14 for holding the shell upright along an axis spaced radially outwardly from the center axis of the tank. The lower end of shell 34 is mounted through an opening 38 formed in tank lower end 16.

A fiber matrix burner 40 of cylindrical shell configuration is vertically mounted concentric with and radially spaced within a combustion tube 42 which is defined by the lower portion of shell 34. Burner 40 is suspended within the combustion tube by an inlet conduit 44 which extends down through an opening concentrically formed in mounting plate 36. The lower end of conduit 44 is connected through a union 46 with an inlet pipe 48 which leads through a divider plate 49 into the inner volume 50 of the burner. Inlet pipe 48 projects through an opening in an insulation collar 52 mounted within shell 34. An insulation end cap 54 is provided at the lower end of the burner to prevent overheating of the burner metal support structure.

A mixture of air and fuel, e.g., natural gas, is directed under pressure into the burner by means of an air blower 56 mounted by supports 58 on top of the tank within an enclosure 60. An air filter 62 is mounted above enclosure 60 and connects through tube 66 with the inlet of the blower. The blower is powered by a motor 68 operated by a suitable control circuit, which can be of conventional design, contained within the enclosure 60. Supply tubing, not shown, connects the gas inlet pipe with a suitable gas valve operated under influence of the control circuit directing such gas through opening 78. The pressurized air mixes with the supply of gas and flows downwardly into the inner volume 50 of the burner, with the gas diffusing outwardly through the interstitial spaces between the fibers of the burner shell 80.

Burner shell 80 is comprised of a fiber matrix composition generally in accordance with the composition described in U.S. Pat. No. 3,383,159, the disclosure of which is incorporated by reference. As generally set forth in that patent, the burner shell is made from a slurry composition of ceramic fibers, binding agent and filler which are vacuum-formed about a metal screen. After high temperature firing the burner shell is comprised of a porous layer of randomly-oriented ceramic fibers with interstitial spaces through which the air/fuel mixture diffuses outwardly. Operation of the burner is characterized in that combustion takes place flamelessly and uniformly on the outer surface layer at about 1800° F., and with relatively little noise. The incandescent, hot surface of the burner shell transfers approximately one-half of the fuel's available energy directly by thermal radiation to the opposing heat sink comprising the combustion tube 42 which in turn heats the surrounding water by conduction and convection. The relatively low thermal conductivity of the fibers in the burner shell, as well as the convective cooling from the incoming flow of air/fuel, allows the burner to operate safely without flashback. This burner is further characterized in operating at very low excess air levels, with relatively low pressure drop, turns on and off instantaneously, and the fiber matrix layer is not susceptible to thermal shock. As a result of the relatively low combustion temperature on the burner surface, the resulting $NO_x$ emissions are less than 15 ppm. The emissions of CO and unburned hydrocarbons are also lower. The burner operates at a heat release rate per unit area of burner surface on the order of 120,000 Btu/hr-ft$^2$. For a typical commercial storage water heater application burner 40 can be sized on the order of 59 kW (200,000 Btu/hr).

Figure 2:
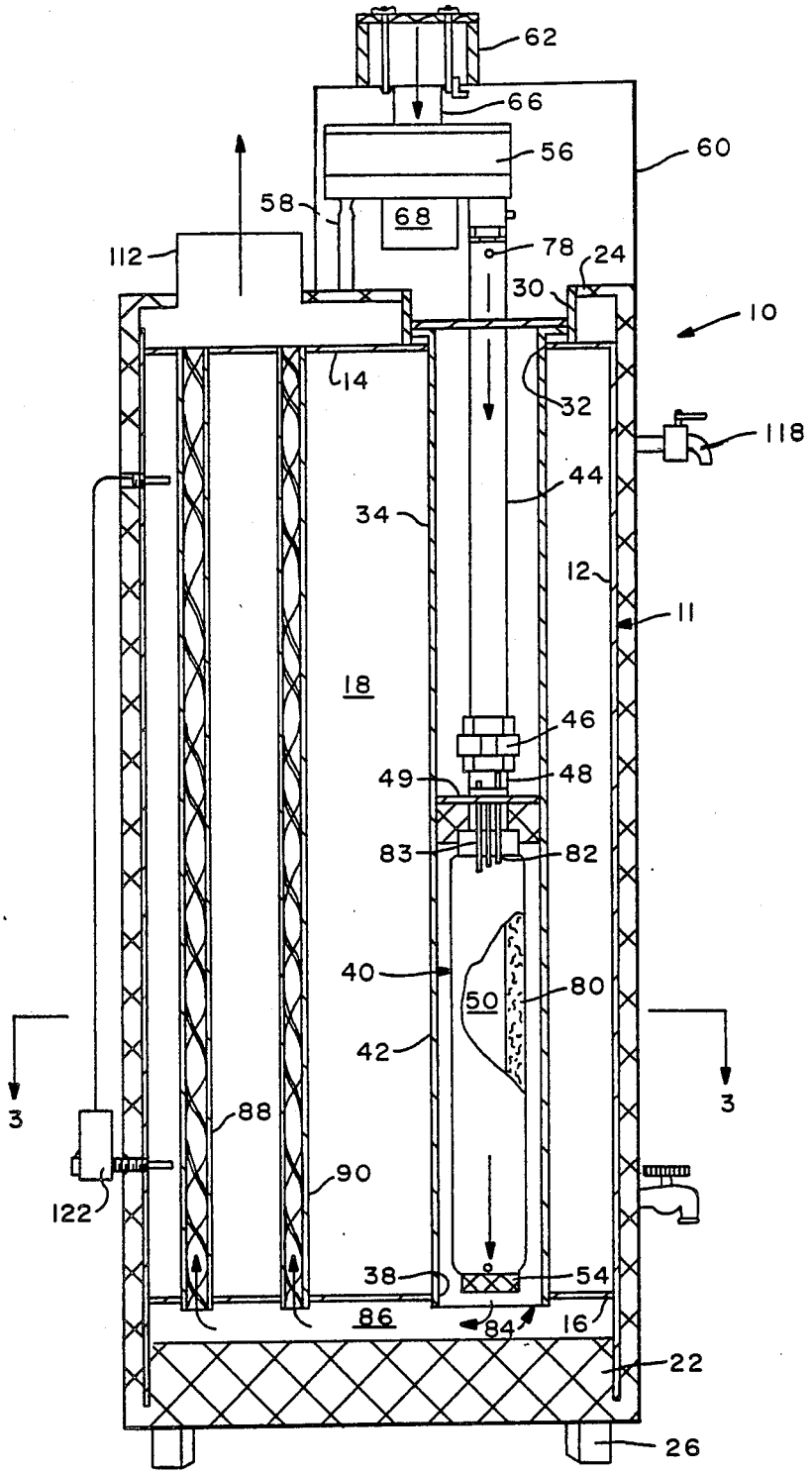
FIG. 2 is a vertical axial section view to an enlarged scale of the water heater of FIG. 1.

Igniter elements 82 depend from plate 49 within the combustion tube 42 and the tips of the elements extend over the upper-end surface of the burner 40. The igniter elements can be either of two types of ignition systems. Direct spark ignition, as shown in FIG. 2, ignites the fuel/air mixture by means of an electrical spark. Alternatively, hot surface ignition, in which a silicon carbide igniter is electrically heated above the fuel/air ignition temperature, can be used. Control circuits appropriate to either ignition system activate the ignition elements through wires, not shown, which extend down through the inside of shell 34. The igniter elements are typically operated only during burner startup. A flame sensing element 83 also activated by the control circuits appropriate to either ignition system senses the presence of a flame using the principle of flame rectification. Ignition control systems employing either direct spark or hot surface ignition with flame rectification flame sensing are commercially available and well known to those knowledgeable in the art.

The products of combustion flow downwardly from the burner and exit through the open end 84 of combustion tube 42 into a flue inlet header 86 which is defined by the space between tank lower end 16 and bottom insulation layer 22. From the inlet header the exhaust gases flow upwardly through a plurality, shown as eight, of flue tubes 88–102 extending vertically through water chamber 18 and which are mounted at their opposite ends through openings formed in the upper and lower ends of the tank. Flue baffles 104, 106 are mounted within each of the flue tubes for creating turbulent flow to enhance heat exchange with the tube walls. A substantial portion of the residual thermal energy in the exhaust gases is thereby transferred to the water within the tank.

Exhaust gases discharge from the upper ends of the flue tubes into an outlet header 108 defined by the space between tank upper end 14 and the top insulation layer 24. The exhaust gases flow from the header through an outlet port 110 and connector tube 112 for venting to a stack, not shown.

A cold water inlet opening 114 is provided at the lower end of the tank, and a hot water outlet opening 116 is provided at the upper end. Alternatively, the water inlet and outlet openings can be set in the tank upper end 14 to allow for water connections through the top of the tank. In such a configuration a dip tube, not shown, would direct the cold inlet water to the bottom of the tank. A pressure relief valve 118 is mounted at the upper end of the tank and a water drain 120 is provided at its lower end.

The use and operation of the invention will be described as applied to a commercial water storage application with tank 11 sized to provide a hot water demand capacity of 3,785 liters/day and with the fiber matrix burner sized at 59 kW. It is understood that systems could be scaled up or down from these sizes and retain essentially the same performance. Under influence of the control circuit the gas valve in enclosure 60 is opened to direct natural gas into inlet 78, and the blower motor is powered to draw air downwardly through filter 62 into blower 56 which forces pressurized air past the gas inlet for mixing with the supply of gas. The air/fuel mixture is forced under pressure into the inner volume of burner 40 from which it passes outwardly through the pores on the burner shell. Actuation of the igniter elements 82 then ignites the mixture which combusts flamelessly and uniformly across the entire active burner surface in a relatively shallow combustion zone. The incandescent burner shell transfers thermal energy primarily by radiation to combustion tube 42 which in turn heats the water. Exhaust gases from the burner flow through inlet header 86 and pass upwardly through the flue tubes which transfer residual thermal energy to the water. Water temperature is sensed by a dual bulb thermostat 122 mounted on the side of the tank, and when the preset water temperature is reached the control circuit shuts off the gas valve and deactivates the blower.

The water heater process of the invention has been demonstrated to achieve a steady state efficiency on the order of 84% as compared to efficiencies in the range of 78% from water heaters of conventional design employing natural draft open flame burners. The increased efficiency of the invention is realized by the novel configuration which achieves more uniform heat transfer and particularly more efficient heat transfer in the radiant zone. Approximately one-half of the available energy is transferred by radiation through the combustion tube into the surrounding water, with a substantial portion of the residual energy being transferred to the water from the flue tubes. The burner also operates with substantially reduced $NO_x$ emissions as compared to conventional heaters employing open-flame type burners.

Other advantages from the invention include the provision of the vertically oriented combustion tube which minimizes the problem of liming inherent in conventional water heaters heated from below. Precipitation build-up of insoluble compounds around the heat transfer surfaces, as is common in hard water environments, is lessened because of the more uniform heat flux along the heat transfer surfaces thus minimizing-hot spots, and precipitate that does form on the vertical tubes will settle onto the tank lower end 16, thus having less of an impact on heat exchange to the water storage tank. This will increase the heater life and reduce the life-cycle cost. Water heater 10 is also safer and more dependable in operation due to the arrangement in which the burner is mounted internally with no open flame exposed to ambient, and is less susceptible to damage by water flooding.

While the foregoing embodiment is at present considered to be preferred it is understood that numerous variations and modifications may be made therein by those skilled in the art and it is intended to cover in the claims all such variations and modifications as fall within the true spirit and scope of the invention.

What is claimed is:

1. A process for heating water in a tank having a water storage chamber through which an upright cylindrical combustion tube extends, the process including the steps of placing water within the storage chamber to a level around the upper portion of the combustion tube, disposing a radiant burner having a fiber matrix cylindrical wall forming an outer combustion surface concentrically within the combustion tube, holding the burner at a position where the combustion surface is radially spaced from and facing a lower portion of the combustion tube which is below the vertical mid-point of the combustion tube, passing a mixture of fuel and air into the burner and radially outwardly through the burner wall, flamelessly combusting the fuel and air mixture on the outer combustion surface, transferring heat from the combustion surface primarily by radiation outwardly to the lower portion of the combustion tube, transferring heat by conduction and convection from the lower portion of the combustion tube to the lower strata of water in the storage tank which surrounds the lower portion and causing cool water in the upper strata surrounding the upper portion of the tube to circulate down in exchange with water in the lower strata heated by the combustion tube.

2. A process as in claim 1 in which the step of combusting the mixture is carried out by flamelessly combusting the mixture uniformly across the outer combustion surface, the step of transferring heat from the combustion surface is carried out by radiating the heat uniformly to the inner surface of the lower portion of the combustion tube, and heat from the lower portion of the combustion tube is transferred to said lower strata to uniformly heat the water therein.

3. A process as in claim 1 in which a plurality of upright flue tubes extend through the chamber including the step of passing exhaust gases from said combustion in a path out from the lower end of the combustion tube and upwardly through and in heat exchange relationship with the flue tubes, and transferring residual heat from the exhaust gases by conduction and convection through the flue tubes into the water in the storage chamber.

4. A process as in claim 3 including the step of directing the exhaust gases from the lower end of the combustion tube into an inlet manifold which is in communication with the ends of the flue tubes at the lower end of the tank, and directing exhaust gases from the inlet manifold into the flue tubes.

5. A process as in claim 1 including the step of passing the fuel and air mixture under pressure in a path downwardly through a conduit in the combustion tube into the radiant burner.

6. A process as in claim 1 including the step of causing insoluble precipitates from water in the storage chamber to gravitate downwardly and deposit on the lower end of the tank substantially free of the outer surface of the combustion tube.

7. A process as in claim 1 in which the fuel and air mixture is combusted on the outer combustion surface at a temperature on the order of 1800° F. at a heat release rate of substantially 120,000 Btu/hr-ft$^2$.

8. A process as in claim 1 in which the step of combusting the mixture is carried out in cycles responsive to the temperature of water in the storage chamber falling below a predetermined value, and the step of transferring heat to the lower strata during each cycle causes said water circulation to be sufficient to minimize stratification of the water temperature and thereby limit temperature rise during such cycle to below another predetermined value.

9. A process for heating water in a tank having a water storage chamber through which an upright cylindrical combustion tube extends and in which a plurality of upright flue tubes extend through the chamber, the process including the steps of placing water within the storage chamber to a level around the upper portion of the combustion tube, disposing a radiant burner having a fiber matrix cylindrical wall forming an outer combustion surface within and radially spaced from the combustion tube, holding the burner at a position where the combustion surface is facing a lower portion of the combustion tube which is below approximately the mid-span of the combustion tube, passing a mixture of fuel and air into the burner and radially outwardly through the burner wall, flamelessly combusting the fuel and air mixture uniformly across the outer combustion surface at a temperature on the order of 1800° F. and at a heat release rate of substantially 120,000 Btu/hr-ft$^2$, said step of combusting the mixture being carried out in cycles responsive to the temperature of water in the storage chamber falling below a predetermined value, transferring heat from the combustion surface primarily by radiation outwardly to the combustion tube by radiating the heat uniformly to the inner surface of the lower portion of the combustion tube, transferring heat by conduction and convection from the lower portion of the combustion tube to the lower strata of water in the storage tank which surrounds the lower portion and causing cool water in the upper strata surrounding the upper portion of the tube to circulate down in exchange with water in the lower strata heated by the combustion tube, said heat from the lower portion of the combustion tube being transferred to said lower strata to uniformly heat the water therein, passing exhaust gases from said combustion in a path out from the lower end of the combustion tube and upwardly through and in heat exchange relationship with the flue tubes, transferring residual heat from the exhaust gases by conduction and convection through the flue tubes into the water in the storage chamber, said step of transferring heat to the lower strata during each cycle causing said water circulation to be sufficient to minimize stratification of the water temperature and thereby limit temperature rise during such cycle to below another predetermined value, and causing insoluble precipitants from water in the storage chamber to gravitate downwardly and deposit on the lower end of the tank substantially free of the outer surface of the combustion tube.

* * * * *